US007903060B2

(12) United States Patent
Hong

(10) Patent No.: US 7,903,060 B2
(45) Date of Patent: Mar. 8, 2011

(54) ORGANIC LIGHT EMITTING DIODE DISPLAY AND DRIVING METHOD THEREOF

(75) Inventor: Soon Kwang Hong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 922 days.

(21) Appl. No.: 11/819,722

(22) Filed: Jun. 28, 2007

(65) Prior Publication Data

US 2008/0100545 A1 May 1, 2008

(30) Foreign Application Priority Data

Oct. 31, 2006 (KR) ..... 10-2006-0106617

(51) Int. Cl.
*G09G 3/32* (2006.01)

(52) U.S. Cl. ..... 345/82; 345/76; 345/204; 315/169.3; 313/463

(58) Field of Classification Search ..... 345/76–79, 345/82–83, 204; 315/169.3; 313/463
See application file for complete search history.

(56) References Cited

U.S. PATENT DOCUMENTS 6,229,508 B1 * 5/2001 Kane ..... 345/82
6,501,448 B1 * 12/2002 Komiya et al. ..... 345/80
6,650,060 B2 * 11/2003 Okuda ..... 315/169.1
7,106,281 B2 * 9/2006 Kim et al. ..... 345/76
7,286,106 B2 * 10/2007 Komiya et al. ..... 345/82
2003/0201729 A1 * 10/2003 Kimura et al. ..... 315/169.3
2003/0214465 A1 * 11/2003 Kimura ..... 345/76
2004/0041750 A1 * 3/2004 Abe ..... 345/76
2007/0080905 A1 * 4/2007 Takahara ..... 345/76

* cited by examiner

*Primary Examiner* — Lun-Yi Lao

(74) *Attorney, Agent, or Firm* — McKenna Long & Aldridge LLP

(57) ABSTRACT

An organic light emitting diode display includes a first driving device that includes a first control electrode supplied with a voltage from a first node, and switches a current path between a second node and a third node in accordance with a voltage of the first node; a second driving device that is connected to be symmetrical with the first driving device through the second node and the third node, and includes a second control electrode supplied with a voltage of the first node; a high-level driving voltage source that supplies a high-level driving voltage via the third node; an organic light emitting diode device that is connected between the second node and a ground voltage source; gate and data lines; first to third switch devices; a driving circuit that drives the first to third switch devices; and a storage capacitor connected between the first node and the third node.

24 Claims, 17 Drawing Sheets

ORGANIC LIGHT EMITTING DIODE DISPLAY AND DRIVING METHOD THEREOF

This application claims the benefit of Korean Patent Application No. P2006-106617 in Korea on Oct. 31, 2006, which is hereby incorporated by reference.

BACKGROUND OF THE INVENTION

1. Field of the Invention

The present invention relates to an organic light emitting diode display and a driving method thereof, and more particularly to an organic light emitting diode display that is adaptive for increasing a display quality by improving ability of a pixel to express a gray scale, and a driving method thereof.

2. Description of the Related Art

Recently, there have been developed various flat panel display devices capable of decreasing their weight and bulk, which are regarded as disadvantages of a cathode ray tube. Such flat panel display devices include a liquid crystal display (hereinafter, referred to as "LCD"), a plasma display panel (hereinafter, referred to as "PDP"), and an electroluminescence device, etc.

The PDP has been regarded as a device having advantages of light weight and thin profile, and adaptive for making a large-dimension screen, as it has a simple structure and can be implemented by relatively simple manufacturing process. However, the PDP has disadvantages of a low luminous efficiency, a low brightness, and high power consumption. An active matrix LCD to which a thin film transistor (hereinafter, referred to as "TFT") is applied as a switching device is difficult to be made large-sized because it is manufactured by using a semiconductor process. But, the demand for the LCD is continuously increasing since the LCD is mainly used as a display device of a notebook computer. In comparison with this, the electroluminescence device is broadly classified into an inorganic electroluminescence device and an organic light emitting diode device in accordance with a material of a luminous layer thereof. The electroluminescence device is a self-luminous device which emits light for itself, and has an advantage in that it has fast response speed, high luminous efficiency, high brightness and wide viewing angle.

The organic light emitting diode device includes an anode electrode formed of a transparent conductive layer on a glass substrate, and an organic compound layer and a cathode electrode that are sequentially disposed on the anode electrode, as shown in FIG. 1. Herein, the cathode electrode is formed of a conductive metal.

The organic compound layer includes a hole injection layer HIL, a hole transport layer HTL, an emission layer EML, an electron transport layer ETL, and an electron injection layer EIL.

If a drive voltage is applied to the anode electrode and the cathode electrode, holes in the hole injection layer HTL and electrons in the electron injection layer respectively move to the emission layer EML to excite the emission layer EML. And, as a result, the emission layer EML emits a visible light. In this way, a picture or an image can be displayed by using the visible light generated from the emission layer EML.

The organic light emitting diode device has been applied to a passive matrix type display device and an active matrix type display device that uses TFTs as switching devices. The passive matrix type selects a pixel in accordance with a current applied to an anode electrode and a cathode electrode which perpendicularly cross each other. On the other hand, the active matrix type selects a pixel by selectively turns-on the TFTs, and maintains the pixel to emit light by using a voltage kept in a storage capacitor.

In a LTPS (Low Temperature Poly Silicon) active matrix type display among them, which is manufactured by using an ELA (Excimer Laser Annealing), a characteristics of a TFT formed at an adjacent pixel region is changed according to a change of a line beam energy that is applied during a crystallization process. As a result, such a change of characteristics of a TFT device causes non-uniformity in brightness between adjacent pixels. In an active matrix type display employing an ELA LTPS substrate, a variety of compensation driving methods are applied in order to overcome the non-uniformity of brightness between adjacent pixels.

The compensation method is largely classified into an analog type compensation method and a digital type compensation method. The analog type compensation method uses a saturation region of a driving TFT, which is formed in a pixel, to overcome a change of a driving current in the pixel. On the other hand, the digital type compensation method uses a driving TFT simply as a switching device, and is able to overcome non-uniformity of brightness, as a change of characteristics of the driving TFT is slight compared to a saturation region thereof.

However, the digital type compensation method causes another problems relating to picture quality such as a flickering and a false counter, etc., and requires characteristics of an organic light emitting diode device that is adaptive for the digital type compensation method.

The analog type compensation method is largely classified into a voltage programmed driving method and a current programmed driving method. Herein, the voltage programmed driving method overcomes only a change in a threshold voltage among non-uniform parameters of a TFT. On the other hand, the current programmed driving method can overcome changes of a threshold voltage and mobility. The voltage programmed driving method directly controls a gate voltage of a driving TFT by using a data driving circuit of voltage driving type. On the other hand, the current programmed driving method lets a current corresponding to a gray scale to be displayed flow through a pixel during a data programming period by using a data driving circuit of current type. And, the current programmed driving method sets a gate voltage of the driving TFT that can controls an amount of driving current by using the current flowing through a pixel during a light emitting period thereby overcoming non-uniformity of brightness caused by differences between TFTs formed in adjacent pixels. Such a current programmed driving method can be classified into a sink type and a source type depending upon a configuration of a data driving circuit and a type of pixel that is matched with the technical configuration of the data driving circuit.

FIG. 2 is a block diagram of an organic light emitting diode display which is driven in a current sink type of the related art, and FIG. 3 is an equivalent circuit diagram showing any one of a plurality of pixels in FIG. 2.

FIG. 2 and FIG. 3, an organic light emitting diode display of the related art includes an organic light emitting diode display panel 16, a gate driving circuit 18, a current sink type data driving circuit 20, and a timing controller 24. Herein, the organic light emitting diode display panel 16 has pixels 22 which are arranged in each crossing part of the gate lines GL and the data lines DL. The gate driving circuit 18 drives the gate line GL. The current sink type data driving circuit 20 drives the data lines DL. The timing controller 24 controls the gate driving circuit 18 and the current sink type data driving circuit 20.

The timing controller 24 re-arranges video signals and supplies them to the current sink type data driving circuit 20. Also, the timing controller 24 generates a plurality of control signals to control driving timings of the current sink type data driving circuit 20 and the gate driving circuit 18.

The gate driving circuit 18 sequentially supplies a gate signal to the gate lines GL in response to a control signal from the timing controller 24.

The current sink type data driving circuit 20 receives current signals having current levels corresponding to video signals and sinks them to a low-level potential voltage source (not shown), thereby driving corresponding pixels 22 in response to control signals from the timing controller 24.

Each of the pixels 22 emit light in accordance with a driving signal to display a gray scale corresponding to a video signal. To this end, each of the pixels 22 includes an organic light emitting diode device OLED, a driving TFT DT, a programming TFT PT, first and second switch TFTs ST1 and ST2, and a storage capacitor Cst, as shown in FIG. 3. Each of the pixels 22 sinks a corresponding current signal through a constant current source Idata for a programming period to charge a control voltage that controls an amount of luminescence of the organic light emitting diode device OLED. Then, each of the pixels 22 makes the organic light emitting diode device OLED emit light by using a driving current according to the control voltage to display a gray scale corresponding to a video signal.

FIG. 4A is an equivalent circuit diagram of a pixel for the programming period, and FIG. 4B is an equivalent circuit diagram of a pixel for a light emitting period.

Referring to FIG. 4A, the first and second switch TFTs ST1 and ST2 are turned-on in response to a scanning pulse having a high logical voltage to allow a current, which is sunk by the constant current source Idata, to be passed from a high-level potential voltage source VDD, through the programming TFT PT and the second switch TFT ST2, to a low-level power voltage source VSS for the programming period. By the such current flow, a voltage Vg charged into a node n1 is stored in the storage capacitor Cst and is maintained for the light emitting period. Referring to FIG. 4B, the first and second switch TFTs ST1 and ST2 are turned-off in response to a scanning pulse having a low logical voltage to stop a current sink operation by the constant current source Idata. In this case, the driving TFT DT is controlled by a voltage difference Vgs between a first node voltage Vg stored at the storage capacitor Cst and a high-level driving voltage VDD thereby adjusting an amount of driving current which flows into the organic light emitting diode OLED, through the high-level potential voltage source VDD, the programming TFT PT, and the second switch TFT ST2.

However, for the organic light emitting diode display of the related art, shown in FIG. 3 and FIG. 4, to accurately realize a gray scale, it should be preconditioned that all characteristics of the programming TFT PT (a threshold voltage, mobility, a constant determined by mobility and a parasitic capacitance, etc) are the same as those of the driving TFT DDT. This is because the first node voltage Vg, which is set for the programming period, reflects only characteristics of the programming TFT PT as shown in FIG. 4A. If the first node voltage Vg charged during the programming period is different with a gate voltage of the driving TFT DT during the light emitting period that follows the programming period, a desired gray scale can not be displayed. Herein, the gate voltage of the driving TFT DT during the light emitting period determines an amount of driving current. Furthermore, in order to increase an ability of charging a current during the programming period, the programming TFT PT is designed to have a size several times larger than the driving TFT DT. Because of this, characteristics discrepancy between the programming TFT PT and the driving TFT DT is deepened. This can be represented by Mathematical Formula 1, as below.

$$Ioled = \frac{Kd}{Kd + Ks}\left[1 + \left(\frac{\mu d - \mu s}{\mu s}\right) + \left(\frac{Vthd - Vths}{Vths}\right)^2\right] Idata \qquad \text{[Mathematical Formula 1]}$$

Herein, Ioled represents a driving current, Idata represents a current which is sunk through the constant current source, Kd represents a constant which is determined by mobility and a parasitic capacitance (Hereinafter, referred to as "a natural constant") of a driving TFT DT, Ks represents a natural constant of a programming TFT PT, μd represents mobility of the driving TFT DT, μs represents mobility of the programming TFT PT, Vthd represents a threshold voltage of the driving TFT DT, and Vths represents a threshold voltage of the programming TFT PT, (Kd+Ks)/Kd represents a scaling ratio (Idata/Ioled) that is for increasing an ability of charging a current during the programming period, and $$\left(\frac{\mu d - \mu s}{\mu s}\right) + \left(\frac{Vthd - Vths}{Vths}\right)^2$$

is a mismatching factor that represents characteristics discrepancy between the driving TFT DT and the programming TFT PT.

In Mathematical Formula 1, if a channel width of the programming TFT PT is 20 μm, a channel length of the programming TFT PT is 10 μm, a threshold voltage of the programming TFT PT is −2.2V and mobility of the programming TFT PT is 50 $cm^2/Vs$, and a channel width of the driving TFT DT is 5 μm, a channel length of the driving TFT DT is 10 μm, a threshold voltage of the driving TFT DT is −2.0V and mobility of the driving TFT DT is 55 $cm^2/Vs$, then a scaling ratio is 25/5 (i.e. five times), and a mismatching ratio between the driving TFT DT and the programming TFT PT is about 10.8%.

However, such a high mismatching ratio exceeding 10% reduces a compensating ability of a current during the programming period and, as a result, decreases ability to express a gray scale during the following light emitting period, thereby reducing a display quality.

SUMMARY OF THE INVENTION

Accordingly, it is an object of the present invention to provide an organic light emitting diode display that is adaptive for improving ability to express a gray scale of a pixel to increase a display quality, and a driving method thereof.

In order to achieve these and other objects of the invention, an organic light emitting diode display according to a first embodiment of the present invention comprises a first driving device that includes a first control electrode supplied with a voltage from a first node, and is connected between a second node and a third node; a second driving device that is connected to be symmetrical with the first driving device through the second node and the third node, and includes a second control electrode supplied with a voltage of the first node; a high-level driving voltage source that supplies a high-level driving voltage via the third node; an organic light emitting diode device that is connected between the second node and a ground voltage source; a gate line and a data line which are crossed each other; a first switch device that selectively connects the data line with the first node; a second switch device that selectively connects the second node with the data line; a third switch device that selectively connects the first control electrode with the second control electrode; a driving circuit that drives the first to third switch devices to turn-on the first to third switch devices, thereby forming a parallel current path between the second node and the third node via the first driving device for a first period, and then to turn-off the first to third switch devices, thereby forming a series current path between the second node and the third node via the first driving device for a second period; and a storage capacitor that is connected between the first node and the third node.

The first switch device has a gate electrode connected to the gate line, a source electrode connected to the first node, and a drain electrode connected to the data line. The second switch device that has a gate electrode connected to the gate line, a source electrode connected to the second node, and a drain electrode connected to the data line. The third switch device that has a gate electrode connected to the gate line, a source electrode connected to the first control electrode, and a drain electrode connected to the second control electrode.

The driving circuit includes a gate driving circuit that supplies a scanning signal to the gate line; a data driving circuit that converts a digital data signal into an analog data current to supply it to the data line; and a timing controller that controls driving timings of the gate driving circuit and the data driving circuit.

The scanning signal is generated as a high logical voltage for the first period, and is generated as a low logical voltage for the second period.

The data driving circuit includes a constant current source that generates the analog data current.

A channel width of the second driving device is larger than that of the first driving device.

A driving current, which flows via the organic light emitting diode device for the second period, is determined according to the following Mathematical Formula.

$$Ioled = \frac{Kd}{2Kd + Ks}\left[1 + \left(\frac{\mu d - \mu s}{\mu s + \mu s}\right) + \left(\frac{Vthd - Vths}{Vths}\right)^2\right] Idata$$

Herein, Idata represents a data current which is generated via the constant current source, Kd represents a natural constant of the first driving device, Ks represents a natural constant of the second driving device, μd represents mobility of the first driving device, μs represents mobility of the second driving device, Vthd represents a threshold voltage of the first driving device, and Vths represents a threshold voltage of the second driving device, (2Kd+Ks)/Kd represents a scaling ratio (Idata/Ioled) that increases an ability of charging a current of the first node during the first period, and $$\left(\frac{\mu d - \mu s}{\mu d + \mu s}\right) + \left(\frac{Vthd - Vths}{Vthd + Vths}\right)^2$$

represents a mismatching factor caused by a characteristics discrepancy between the first and second driving devices.

An organic light emitting diode display according to the second embodiment of the present invention further includes a sub capacitor that cuts-off a current path via the second driving device during the second period.

The sub capacitor is connected between the second control electrode and the gate line.

An organic light emitting diode display according to the third embodiment of the present invention further includes an emission device that switches a current path formed between the second node and the organic light emitting diode device.

The emission device includes a gate electrode connected to the gate line, a drain electrode connected to the second node, and a source electrode connected to the organic light emitting diode device.

The first and second driving devices and the first to third switch devices are P-type MOSFETs, and the emission device is a N-type MOSFET.

An organic light emitting diode display according to the fourth embodiment of the present invention further includes a sub capacitor that cuts-off a current path via the second driving device during the second period; and an emission device that switches a current path formed between the second node and the organic light emitting diode device.

In the organic light emitting diode display, the sub capacitor is connected between the second control electrode and the gate line.

In the organic light emitting diode display, the emission device includes a gate electrode connected to the gate line, a drain electrode connected to the second node, and a source electrode connected to the organic light emitting diode device.

In the organic light emitting diode display, the first and second driving devices and the first to third switch devices are P-type MOSFETs, and the emission device is a N-type MOSFET.

A method of driving an organic light emitting diode display, including a first driving device that includes a first control electrode supplied with a voltage of a first node, and is connected between a second node and a third node, a second device that is connected to be symmetrical with the first driving device via the second node and the third node, and includes a second control electrode supplied with a voltage of the first node, a high-level driving voltage source that supplies a high-level driving voltage via the third node, an organic light emitting diode device that is connected between the second node and a ground voltage source, a gate line and a data line which are crossed each other, a first switch device that selectively connects the data line with the first node, a second switch device that selectively connects the second node with the data line, a third switch device selectively connects the first control electrode with the second control electrode, a driving circuit that drives the switch devices, and a storage capacitor that is connected between the first node and the third node, the method comprises turning-on the first to third switch devices to form a parallel current path between the second node and the third node via the first and second driving devices during a first period; and turning-off the first to third switch devices to form a series current path between the second node and the third node via the first driving device during a second period following the first period in response to a scanning signal from the gate line.

In the method, the scanning signal are generated as a high logical voltage during the first period, and are generated as a low logical voltage during the second period.

In the method, the driving circuit includes a constant current source that generates an analog data current corresponding to a digital data signal.

In the method, a channel width of the second driving device is larger than that of the first driving device.

In the method, a driving current, which flows via the organic light emitting diode device during the second period, is determined according to the following Mathematical Formula.

$$Ioled = \frac{Kd}{2Kd + Ks}\left[1 + \left(\frac{\mu d - \mu s}{\mu s + \mu s}\right) + \left(\frac{Vthd - Vths}{Vthd + Vths}\right)^2\right] Idata$$

Herein, Idata represents a data current which is generated via the constant current source, Kd represents a natural constant of the first driving device, Ks represents a natural constant of the second driving device, μd represents mobility of the first driving device, μs represents mobility of the second driving device, Vthd represents a threshold voltage of a first driving device, and Vths represents a threshold voltage of the second driving device, (2Kd+Ks)/Kd represents a scaling ratio (Idata/Ioled) that increases an ability of charging a current of the first node during the first period, and $$\left(\frac{\mu d - \mu s}{\mu d + \mu s}\right) + \left(\frac{Vthd - Vths}{Vthd + Vths}\right)^2$$

represents a mismatching factor caused by a characteristics discrepancy between the first and second driving devices.

A method of driving an organic light emitting diode display according to the second embodiment of the present invention further includes cutting-off a current path via the second driving device by using a sub capacitor connected between the second control electrode and the gate line during the second period.

A method of driving an organic light emitting diode display according to the third embodiment of the present invention further includes switching a current path formed between the second node and the organic light emitting diode device by using an emission device responding to the scanning pulse.

A method of driving an organic light emitting diode display according to the fourth embodiment of the present invention further includes cutting-off a current path via the second driving device by using a sub capacitor connected between the second control electrode and the gate line during the second period; and switching a current path formed between the second node and the organic light emitting diode device by using an emission device responding to the scanning pulses.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to FIG. 5 to FIG. 13.

Figure 5:
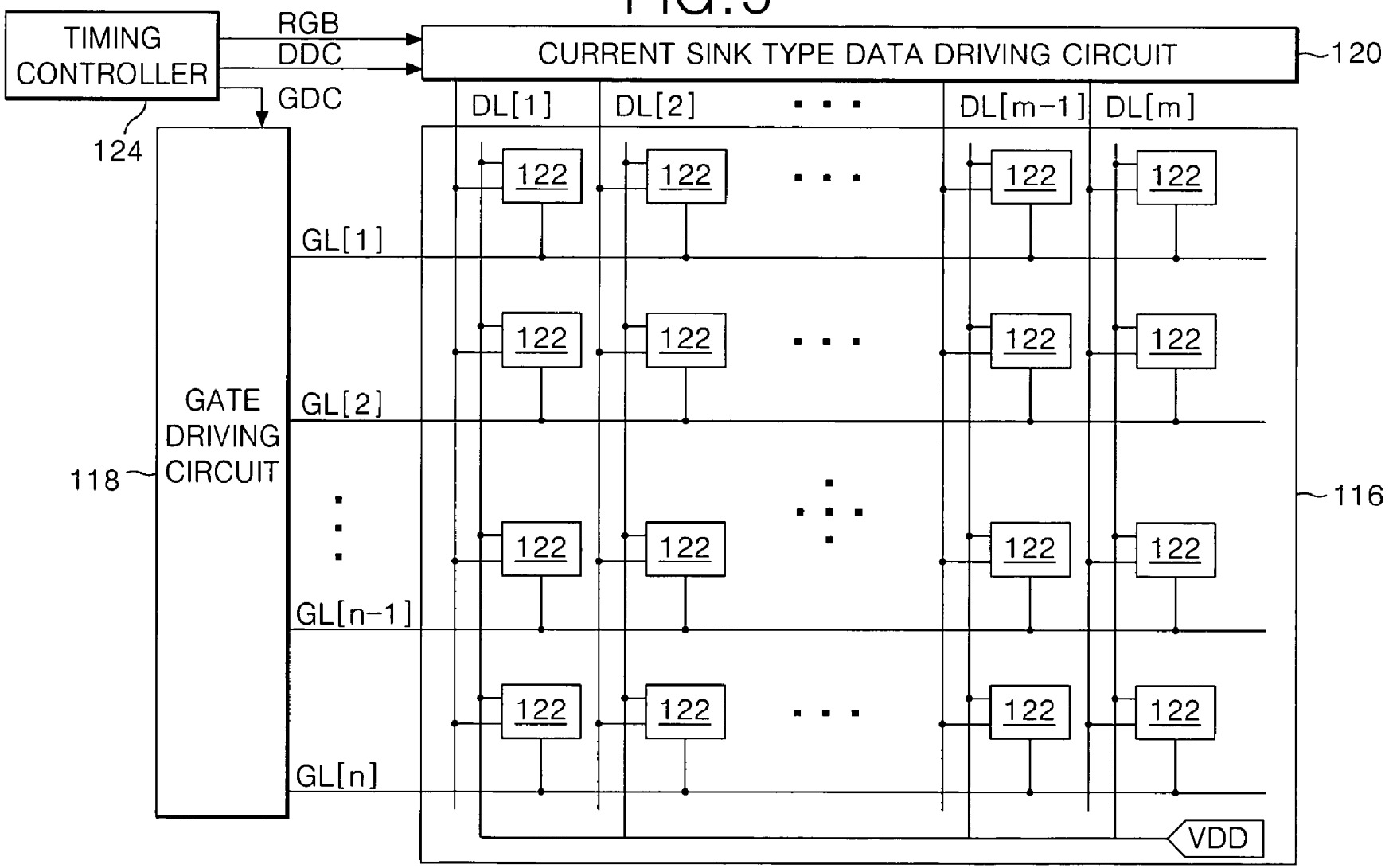
FIG. 5 is a block diagram showing an organic light emitting diode display according to the present invention.
Figure 6:
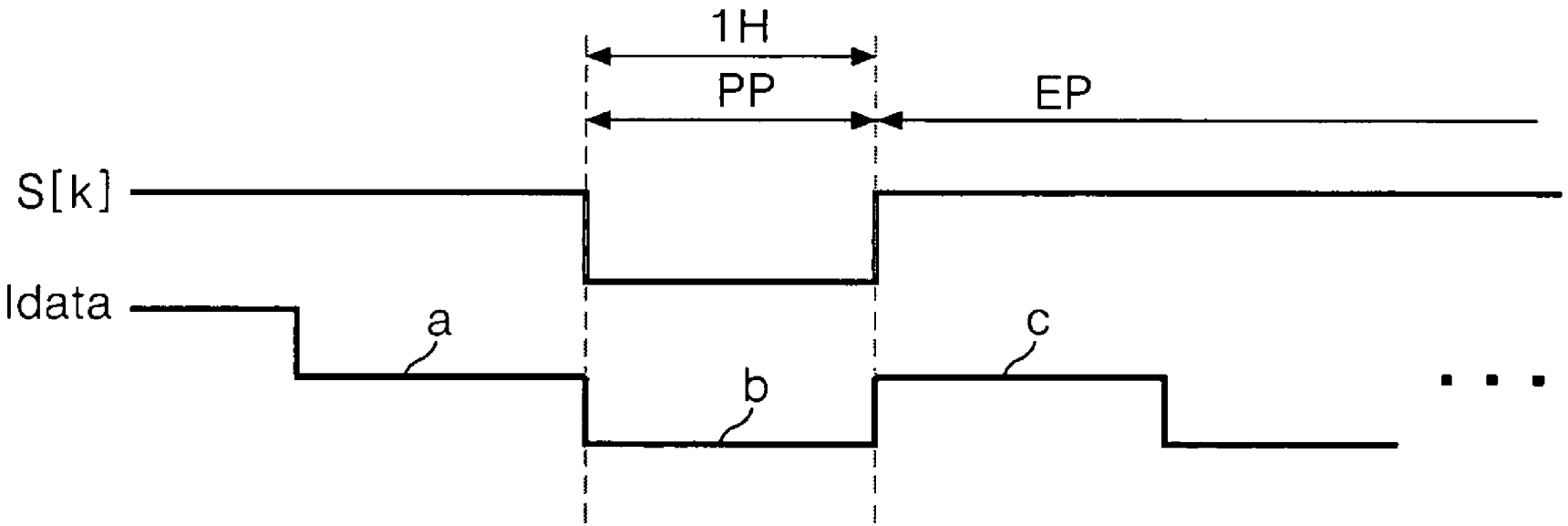
FIG. 6 is a timing diagram showing a scanning pulse applied to kth (herein, k is a positive integer, 1≦k≦n) pixels which are located in a vertical direction of FIG. 5 and a data current which is sunk from any one of the pixels to a data driving circuit.

FIG. 5 is a block diagram showing an organic light emitting diode display according to the present invention, and FIG. 6 is a timing diagram showing a scanning pulse S[k] applied to kth (herein, k is a positive integer, 1≦k≦n) pixels which are located in a vertical direction of FIG. 5 and a data current Idata which is sunk from any one of the pixels to a data driving circuit.

Referring to FIG. 5 and FIG. 6, the organic light emitting diode display according to the present invention includes a display panel 116, a current sink type data driving circuit 120, a gate driving circuit 118, and a timing controller 124. Herein, the display panel 116 has m×n pixels 122. The current sink type data driving circuit 120 sinks a data current Idata from the pixels 122 through data lines DL[1] to DL [m]. The gate driving circuit 118 supplies a scanning pulse S to gate lines GL[1] to GL[n] which are crossed with the data lines DL[1] to DL[m]. The timing controller 124 controls driving timings of the current sink type data driving circuit 120 and the gate driving circuit 118.

On the display panel 116, the pixels 122 are formed at pixel areas defined by crossings of n gate lines GL[1] to GL[n] and m data lines DL[1] to DL[m]. Also, signal lines, which supply a driving voltage from the high-level voltage source VDD to each of the pixels 122, are formed on the display panel 116. Furthermore, signal lines, which supply a ground voltage from a ground voltage source GND to each of the pixels 122, are formed at the display panel 116.

The current sink type data driving circuit 120 sinks a current signal Idata, which has a level corresponding to a digital video signal RGB, from a pixel 122 to a low-level voltage source (not shown) in response to control signals from the timing controller 124. To this end, the current sink type data driving circuit 120 includes a voltage control current source type switch device (not shown: hereinafter, referred to as "a constant current source") which is connected to the low-level voltage source. To a gate electrode of the voltage control current source type switch device (not shown), a control voltage corresponding to a digital video signal is applied. The current sink type data driving circuit 120 sinks a data current Idata having the same level as a positive current, which flows between a drain electrode and a source electrode of the constant current source, to the low-level voltage source.

The gate driving circuit 118 sequentially supplies a scanning pulse S[k] shown in FIG. 6 to the gate lines GL[1] to GL[n] in response to a control signal GDC from the timing controller 124.

The timing controller 124 supplies digital video data RGB to the current sink type data driving circuit 120, and generates control signals DDC and GDC, which determine driving timings of the gate driving circuit 118 and the data driving circuit of current sink type 120, by using vertical/horizontal synchronization signals and a clock signal, etc.

A mark PP of FIG. 6 represents a programming period when a data current Idata is sunk in accordance with a gray scale to set a control voltage for controlling an amount of luminescence. A mark EP of FIG. 6 represents a light emitting period when the organic light emitting diode emits light in accordance with the set control voltage. Furthermore, a mark 'a' represents a data current Idata which is sunk for (k−1)th horizontal period, a mark 'b' represents a data current Idata which is sunk for kth horizontal period, a mark 'c' represents a data current Idata which is sunk for (k+1)th horizontal period. In FIG. 6, a programming period is about 1 horizontal period, and levels (b) of data currents Idata, which are sunk from the pixels 122, are equal for the 1 horizontal period. An operation of the pixels 122 for the programming period PP and the light emitting period EP will be described in detail with reference to pixel circuits according to first to fourth embodiments of the present invention.

Figure 7:
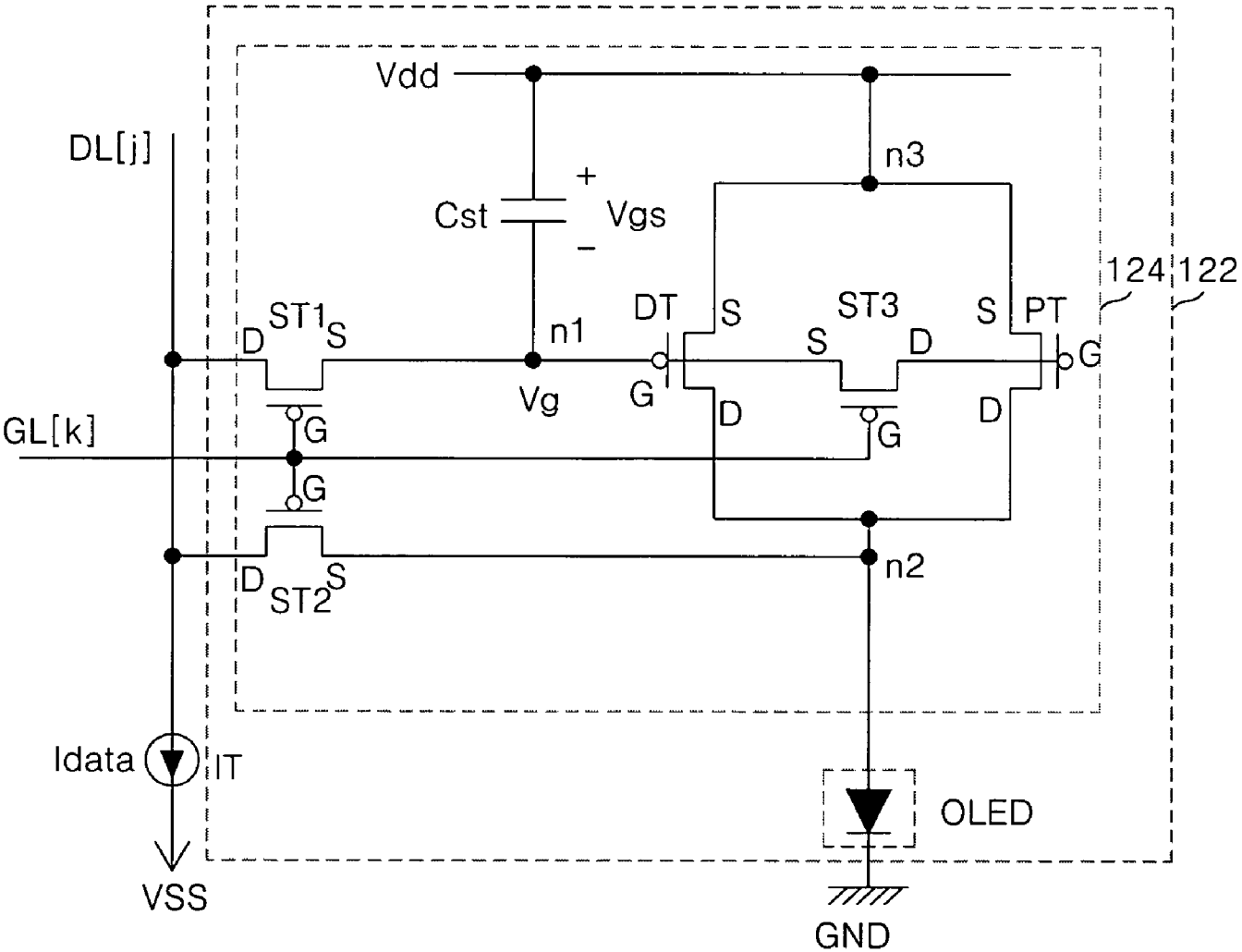
FIG. 7 is a circuit diagram showing a pixel according to the first embodiment of the present invention.
Figure 8A:
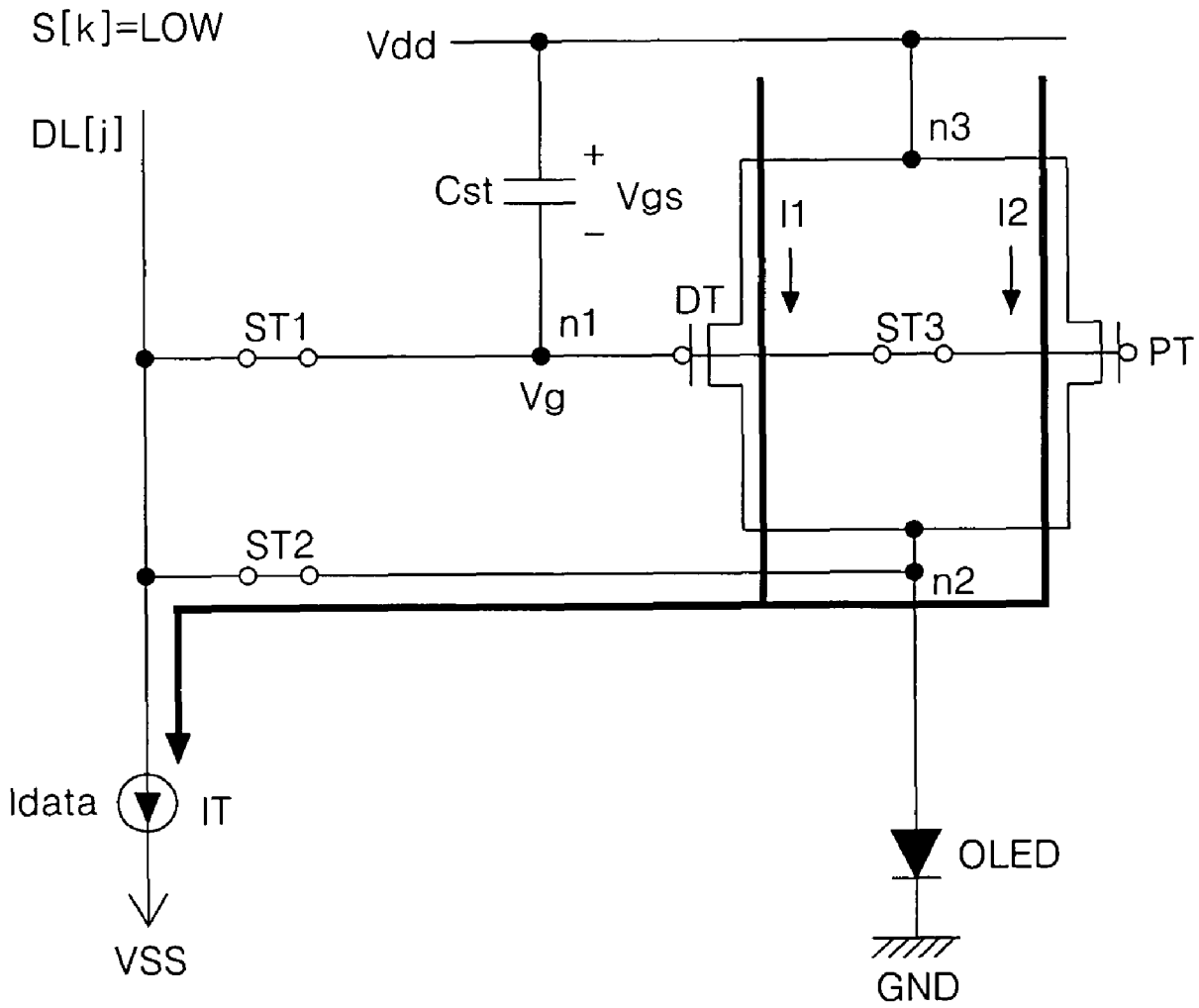
FIG. 8A is an equivalent circuit diagram of a pixel shown in FIG. 7 for the programming period PP.
Figure 8B:
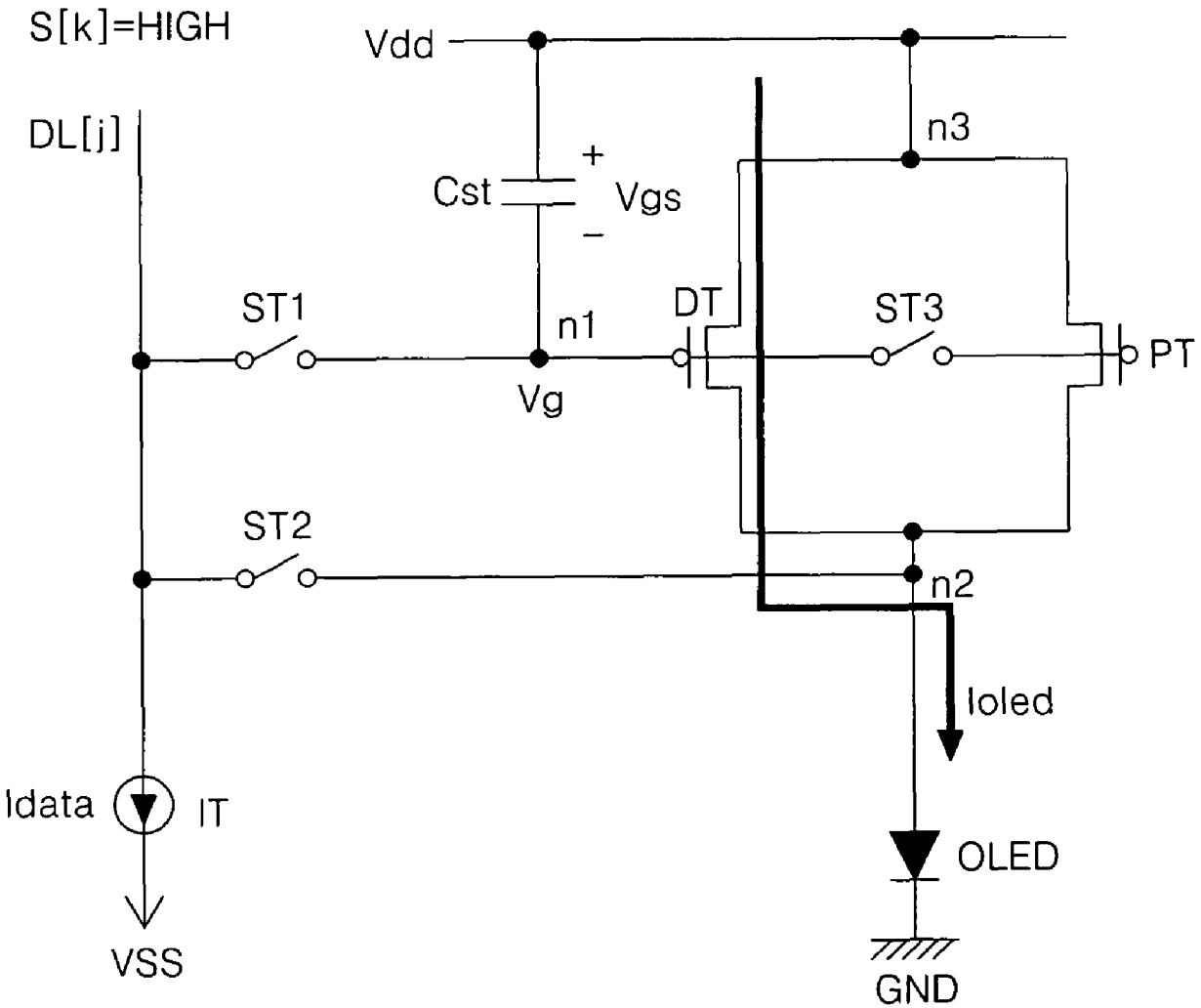
FIG. 8B is an equivalent circuit diagram of a pixel shown in FIG. 7 for the light emitting period EP.

FIG. 7 to FIG. 8B show a pixel 122 according to the first embodiment of the present invention.

FIG. 7 is a circuit diagram showing a pixel 122 which is located at a kth location (herein, k is a positive integer, $1 \leqq k \leqq n$) in a vertical direction of FIG. 5, and is located at a jth location (herein, j is a positive integer, $1 \leqq j \leqq m$) in a horizontal direction of FIG. 5.

Referring to FIG. 7, the pixel 122 includes an organic light emitting diode device driving circuit 124 and an organic light emitting diode device OLED. Herein, the organic light emitting diode device driving circuit 124 reflects characteristics of a first driving TFT (hereinafter, referred to as "a driving TFT") and a second driving TFT (hereinafter, referred to as "a programming TFT) to set a control voltage Vg. The organic light emitting diode device OLED adjusts an amount of luminescence in accordance with the set control voltage Vg.

The organic light emitting diode device driving circuit 124 includes a switch circuit that has first to third switch TFTs ST1 to ST3, the programming TFT PT, the storage capacitor CSt, and the driving TFT DT. Herein, the TFTs are P-type Metal-Oxide Semiconductor Field Effect Transistors MOSFETs.

The switch circuit switches a current path between the first node n1 and the data line DL[j], a current path between the second node n2 and the data line DL[j], and the gate electrode G of the driving TFT DT and the gate electrode of the programming TFT PT in response to the scanning pulse S[k]. Herein, the gate electrode G of the first switch TFT ST1 is connected to the gate line GL[k], and the source electrode S thereof is connected to the first node n1, and the drain electrode D thereof is connected to the data line DL[j]. The gate electrode G of the second switch TFT ST2 is connected to the gate line GL[k], and the source electrode thereof is connected to the second node n2, and the drain electrode D thereof is connected to the data line DL[j]. The gate electrode G of the third switch TFT ST3 is connected to the gate line GL[k], the source electrode S thereof is connected to the gate electrode G of the driving TFT DT, and the drain electrode D thereof is connected to the gate electrode G of the programming TFT PT. A control voltage Vg is charged into the first node n1 during the programming period PP due to a flow of the data current Idata by switching operations of the switch circuit.

The programming TFT PT reflects its characteristics (a threshold voltage, mobility, and a natural constant, etc) to the control voltage Vg, which is charged into the first node n1, during the programming period PP. The gate electrode G of the programming TFT PT is connected to the first node n1, the source electrode S thereof is connected to the high-level driving voltage source VDD, and the drain electrode thereof is connected to the second node n2. The programming TFT PT may be formed to have a size several times larger than the driving TFT DT so as to reduce a charging time of current within the pixel 122 during the programming period PP.

The driving TFT DT reflects its characteristics (a threshold voltage, mobility, and a natural constant, etc) to the control voltage Vg, which is charged into the first node n1 during the programming period PP, and then controls an amount of driving current flowing into the organic light emitting diode device OLED by using a difference voltage Vgs between the high-level driving voltage and the control voltage Vg during the light emitting period EP. Herein, the gate electrode G of the driving TFT DT is connected to the first node n1, the source electrode S thereof is connected to the high-level driving voltage source VDD, and the drain electrode D thereof is connected to the second node n2.

The storage capacitor Cst stores the difference voltage Vgs between the high-level driving voltage and the control voltage Vg to maintain it for one frame. The storage capacitor Cst is connected between the high-level driving voltage source VDD and the first node n1.

Figure 1:
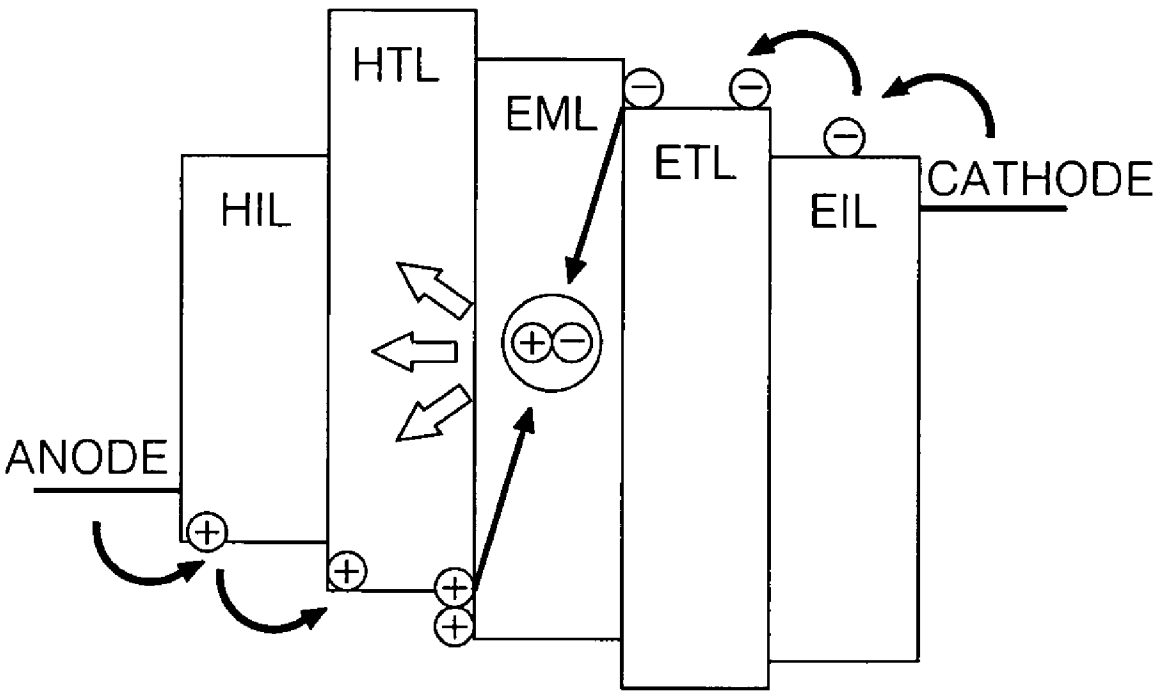
FIG. 1 RELATED ART
FIG. 1 is a diagram schematically showing a structure of an organic light emitting diode device of the related art.
Figure 2:
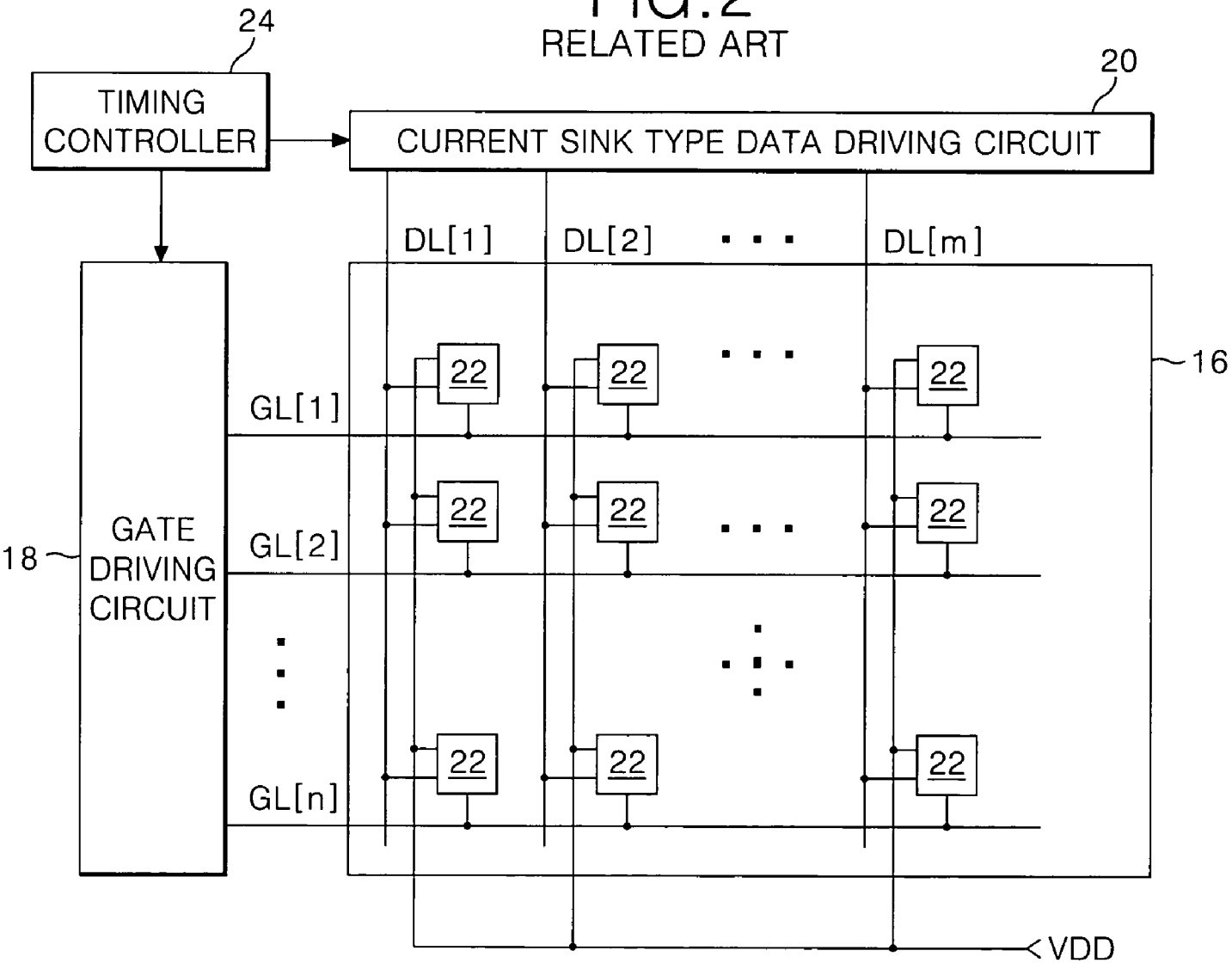
FIG.2 RELATED ART
FIG. 2 is a block diagram showing an organic light emitting diode display which is driven in a current sink type of the related art.
Figure 3:
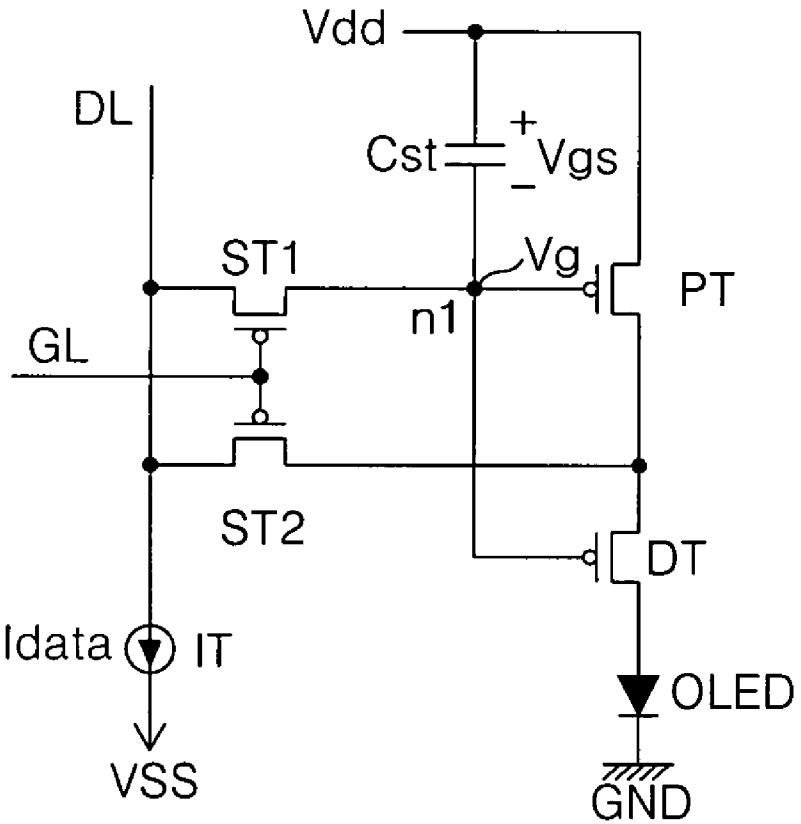
FIG. 3 RELATED ART
FIG. 3 is a circuit diagram equivalently showing any one of a plurality of pixels shown in FIG. 2.
Figure 4A:
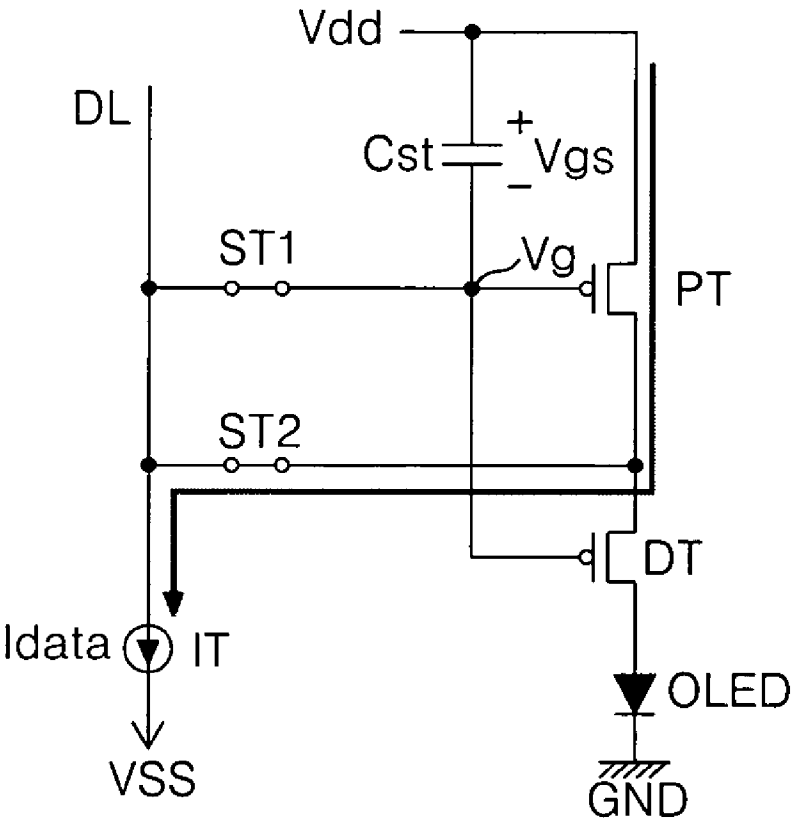
FIG. 4A RELATED ART
FIG. 4A is an equivalent circuit diagram of a pixel for a programming period.
Figure 4B:
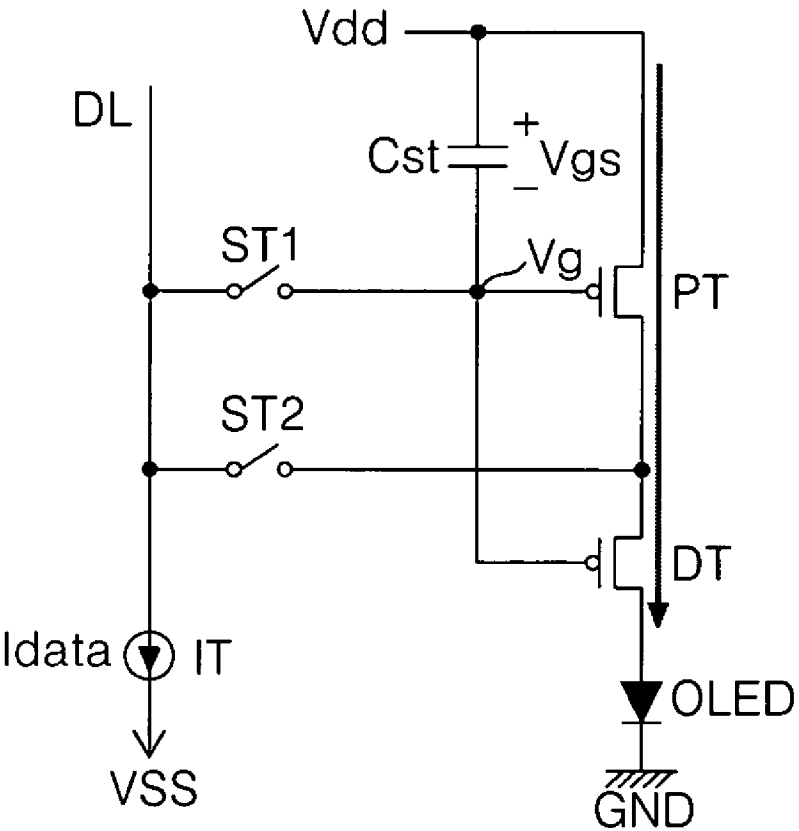
FIG. 4B RELATED ART
FIG. 4B is an equivalent circuit diagram of a pixel for a light emitting period.

The organic light emitting diode device OLED has a structure as shown in FIG. 1, and displays a gray scale by controlling an amount of luminescence thereof in accordance with the difference voltage Vgs between the high-level driving voltage and the control voltage Vg.

FIG. 8A is an equivalent circuit diagram of the pixel 122 shown in FIG. 7 during the programming period PP, and FIG. 8B is an equivalent circuit diagram of the pixel 122 shown in FIG. 7 during the light emitting period EP.

An operation of the pixel 122 will be described with reference to FIG. 8A and FIG. 8B as follows.

As shown in FIG. 8A, the scanning pulse S[k] is generated as a high logical voltage to turn-on the first to third switch TFTs ST1, ST2, and ST3 during the programming period PP. As the first to third switch TFTs ST1, ST2, and ST3 are turned on, current paths between the first node n1 and the data line DL [j], between the second node n2 and the data line DL[j], and between the gate electrode of the driving TFT DT and the gate electrode of the programming TFT PT are connected. In this state, if the data current Idata from the pixel 122 is sunk to the low-level voltage source VSS by a constant current source IT, the first and second nodes n1 and n2 and the data line DL[j] have the same voltage Vg due to electric charges which are accumulated by the data current Idata. The data voltage Idata is the sum of a first current I1 and a second current I2. Herein, the first current I1 flows via the driving TFT DT between the third node n3 and the second node n2. The second current I2 flows via the programming TFT PT between the third node n3 and the second node n2. Since the programming TFT PT may be formed to have a size several times larger than the driving TFT DT so as to reduce a charging time, the second current I2 has a level several times higher than the first current I1. Characteristics of the driving TFT DT (mobility, and a threshold voltage, etc) are reflected to the first current I1, and characteristics of the programming TFT PT (mobility, and a threshold voltage, etc) are reflected to the second current I2. The control voltage Vg is charged into the first node n1 by reflecting characteristics of the programming TFT PT as well as characteristics of the driving TFT DT. Accordingly, after characteristics of the driving TFT DT are completely reflected, the difference voltage Vgs between the high-level driving voltage and the control voltage Vg is stored at the storage capacitor Cst and is maintained for one frame.

As shown in FIG. 8B, the scanning pulse S[k] is inversed to a low logical voltage to turn-off the first to third switch TFTs ST1, ST2, and ST3 during the light emitting period EP. As the first to third switch TFTs ST1, ST2, and ST3 are turned off, paths between the first node n1 and the data line DL[j], between the second node n2 and the data line DL[j], and between the gate electrode of the driving TFT DT and the gate electrode of the programming TFT PT are opened. The programming TFT PT is floated by a turn-off of the third switch TFT ST3, while the driving TFT DT maintains a turned-on state by the difference voltage Vgs stored at the storage capacitor Cst. Then, the driving TFT DT controls an amount of driving current Ioled supplied to the organic light emitting diode device OLED in response to the difference voltage Vgs. Therefore, the organic light emitting diode device OLED displays a gray scale by controlling an amount of its luminescence according to the amount of driving current Ioled.

A relationship between the driving current Ioled and the data current Idata of the pixel 122 according to the first embodiment can be represented as the following Mathematical Formula 2.

$$Ioled = \frac{Kd}{2Kd + Ks}\left[1 + \left(\frac{\mu d - \mu s}{\mu s + \mu s}\right) + \left(\frac{Vthd - Vths}{Vthd + Vths}\right)^2\right] Idata \quad \text{[Mathematical Formula 2]}$$

Herein, Ioled represents a driving current, Idata represents a data current which is sunk via the constant current source IT, Kd represents a natural constant of the driving TFT DT, Ks represents a natural constant of the programming TFT PT, pd represents mobility of the driving TFT DT, μs represents mobility of the programming TFT PT, Vthd represents a threshold voltage of the driving TFT DT, and Vths represents a threshold voltage of the programming TFT PT, respectively. Furthermore, (2Kd+Ks)/Kd represents a scaling ratio (Idata/Ioled) that increases an ability of charging a current during the programming period, and $$\left(\frac{\mu d - \mu s}{\mu d + \mu s}\right) + \left(\frac{Vthd - Vths}{Vthd + Vths}\right)^2$$

is a mismatching factor that represents a characteristics discrepancy between the programming TFT PT and the driving TFT DT.

Herein, if the same conditions as the related art is put into Mathematical Formula 2, a mismatching ratio between the programming TFT PT and the driving TFT DT according to the present invention is decreased compared to that of the related art, while a scaling ratio is increased compared to that of the related art.

In other words, in Mathematical Formula 2, if a channel width of the programming TFT PT is 20, a channel length of the programming TFT PT is 10, a threshold voltage of the programming TFT PT is −2.2V and mobility of the programming TFT PT is 50/Vs, and a channel width of the driving TFT DT is 5, a channel length of the driving TFT DT is 10, a threshold voltage of the driving TFT DT is −2.0V and mobility of the driving TFT DT is 55/Vs, then a mismatching ratio of between the programming TFT PT and the driving TFT DT both TFTs is about 5% which is less than a half of 10.8% in the related art. Herein, this is a result that is obtained by reflecting characteristics of the driving TFT DT (a threshold voltage, and mobility, etc) when charging the control voltage Vg during the programming period PP. Since a mismatching ratio is sharply decreased according to the present invention, ability to express a gray scale during the light emitting period EP is increased, thereby highly improving a display quality compared to the related art. Furthermore, in the same conditions, a scaling ratio according to the present invention becomes six times (30/5), which is increased compared to five times of the related art. As a result, the preset invention can reduce a charging time of the control voltage Vg by increasing the scaling ratio.

Figure 9:
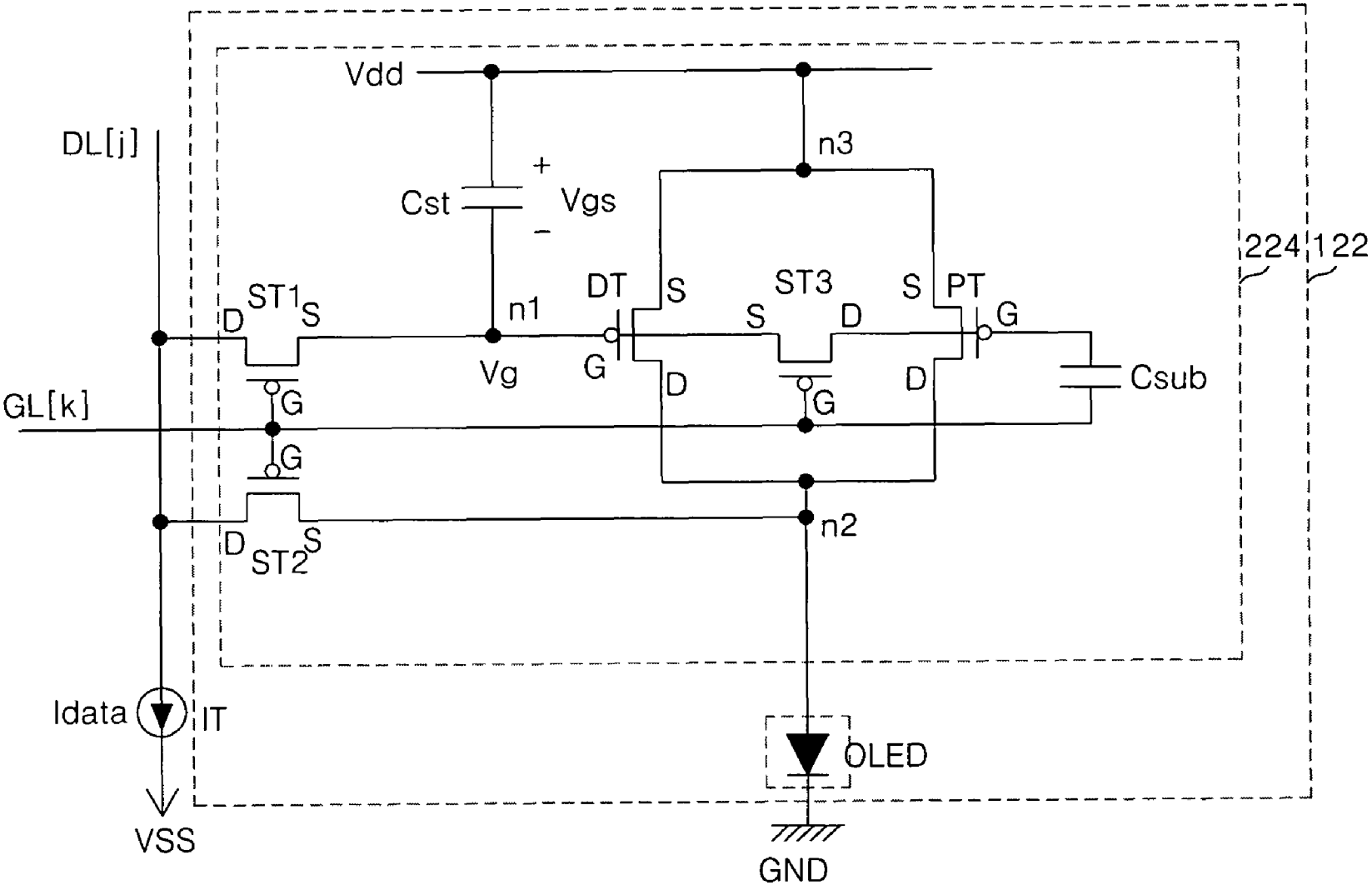
FIG. 9 is a circuit diagram showing a pixel according to the second embodiment of the present invention.
Figure 10A:
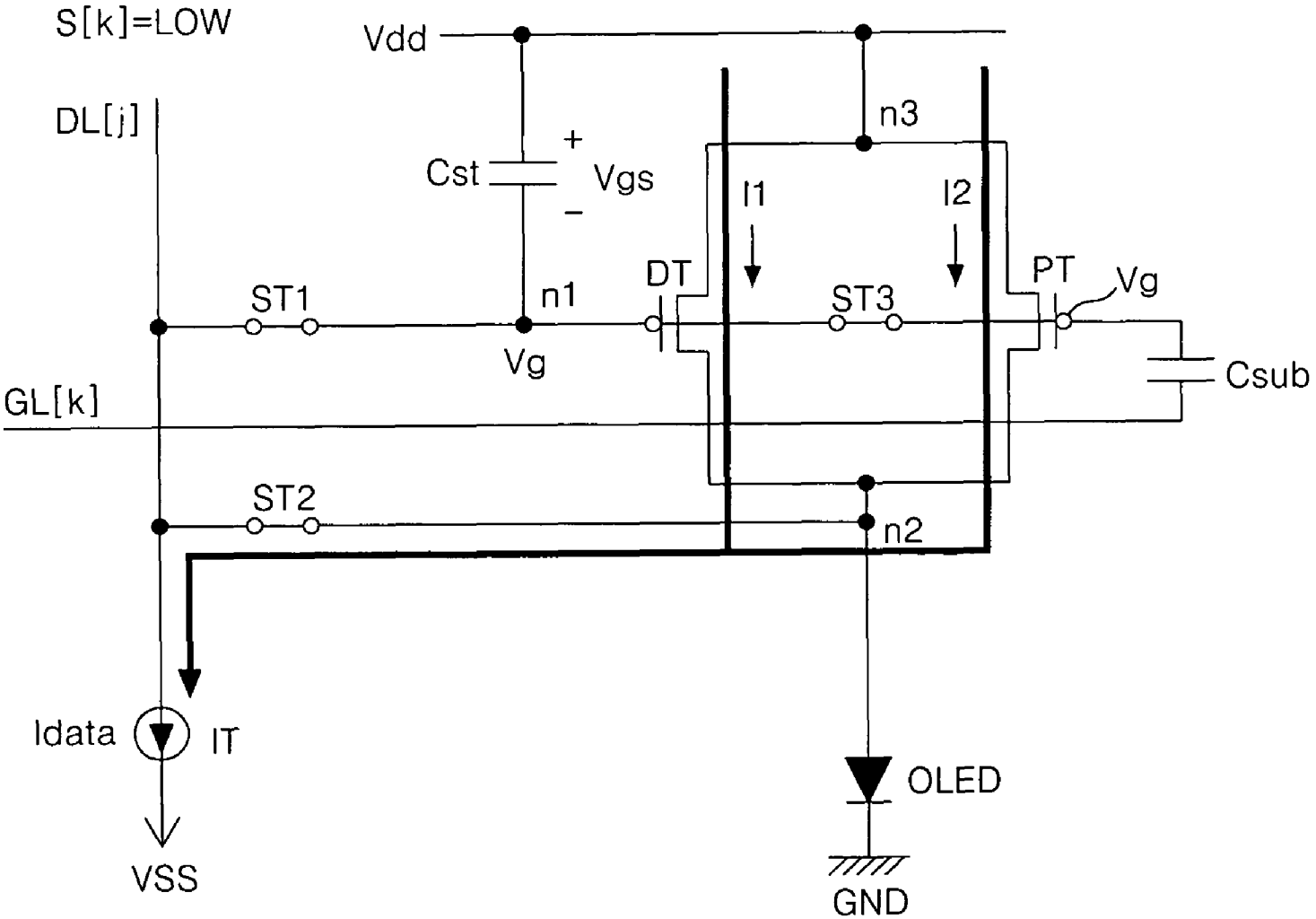
FIG. 10A is an equivalent circuit diagram of a pixel shown in FIG. 9 for the programming period PP.
Figure 10B:
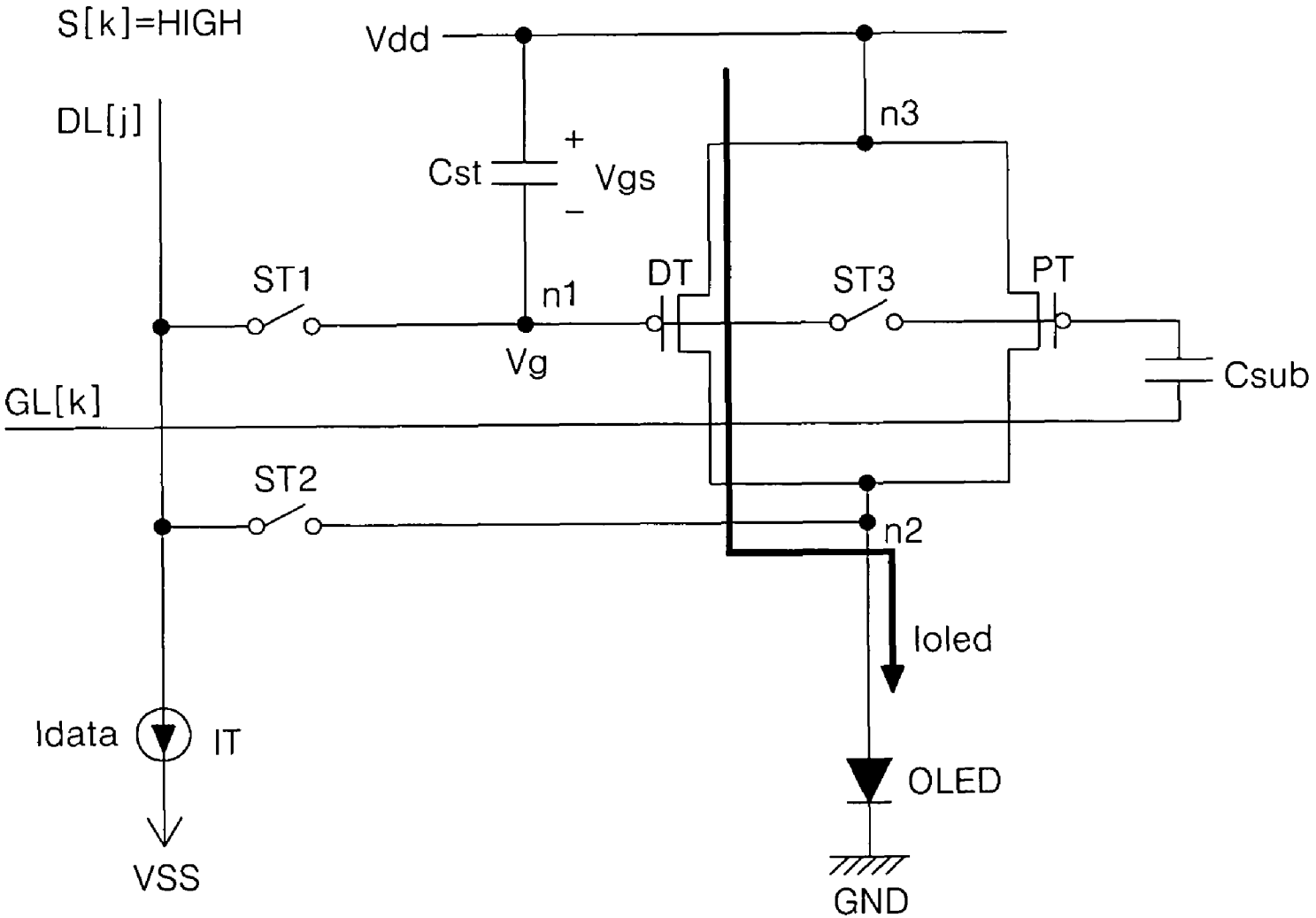
FIG. 10B is an equivalent circuit diagram of a pixel shown in FIG. 9 for the light emitting period EP.

FIG. 9 to FIG. 10B show a pixel 122 according to the second embodiment of the present invention.

FIG. 9 is a circuit diagram showing the pixel 122 which is located at a kth location (herein, k is a positive integer, 1≦k≦n) in a vertical direction of FIG. 6, and is located at a jth location (herein, j is a positive integer, 1≦j≦m) in a horizontal direction of FIG. 6. FIG. 10A is an equivalent circuit diagram of the pixel 122 shown in FIG. 9 during the programming period PP, and FIG. 10B is an equivalent circuit diagram of the pixel 122 shown in FIG. 9 during the light emitting period EP. The pixel 122 according to the second embodiment of the present invention has similar configurations in its function and operation except for a sub capacitor Csub compared to a pixel according to the first embodiment. Accordingly, the same reference numerals as the first embodiment are given to other configurations except for the sub capacitor Csub, and a specific description of operations thereof will be omitted.

Referring to FIG. 9, the sub capacitor Csub is connected between the gate electrode G of the programming TFT PT and the gate line GL[k]. The sub capacitor Csub has very small size compared to the storage capacitor Cst. The sub capacitor Csub can be formed by using a parasitic capacitance or a cross-over capacitance which reside on a layout of pixels, not introducing additional processes. Thus, although the sub capacitor Csub is added, practically, it does not decrease an aperture ratio of a pixel.

Referring to FIG. 10A and FIG. 10B, the scanning pulse S[k] is generated as a high logical voltage to turn-on the first to third switch TFTs ST1, ST2, and ST3 during the programming period PP. In this state, if the data current Idata from the pixel 122 is sunk to the low-level voltage source VSS by a constant current source IT, the same control voltages Vg are applied both to the gate electrode G of the driving TFT DT and the gate electrode G of the programming TFT PT. Next, the scanning pulse S[k] is inversed to a low logical voltage to turn-off the first to third switch TFTs ST1, ST2, and ST3 during the light emitting period EP. In this case, if the sub capacitor Csub is not formed, the gate electrode G of the programming TFT PT is floated by a turn-off of the third switch TFT ST3. Herein, when the gate electrode G of the programming TFT PT is floated, a voltage applied to the gate electrode G of the programming TFT PT has a level of the control voltage Vg that is capable of turning-on the programming TFT PT. Thus, an unnecessary current can flow via the programming TFT PT during the light emitting period EP. In this case, this unnecessary current can reduce a contrast ratio. However, if a potential of one side electrode of the sub capacitor Csub is increased by the scanning pulse S[k] that is inverted from a high logical voltage to a low logical voltage, accordingly, a potential of the other side of the sub capacitor Csub is also increased. As the gate electrode G of the programming TFT PT is connected to the other side electrode of the sub capacitor Csub, a potential of the gate electrode G of the programming TFT PT is also increased to a level that is capable of turning-off the programming TFT PT. Briefly, the sub capacitor Csub increases a gate voltage of the programming TFT PT at a point when the programming period PP is changed to the light emitting period EP to fully cut-off a flow of a current through the programming TFT PT during the light emitting period EP.

As a result, the pixel 122 according to the second embodiment of the present invention can further improve a contrast ratio by adding the sub capacitor Csub to a pixel according to the first embodiment of the present invention.

Figure 11:
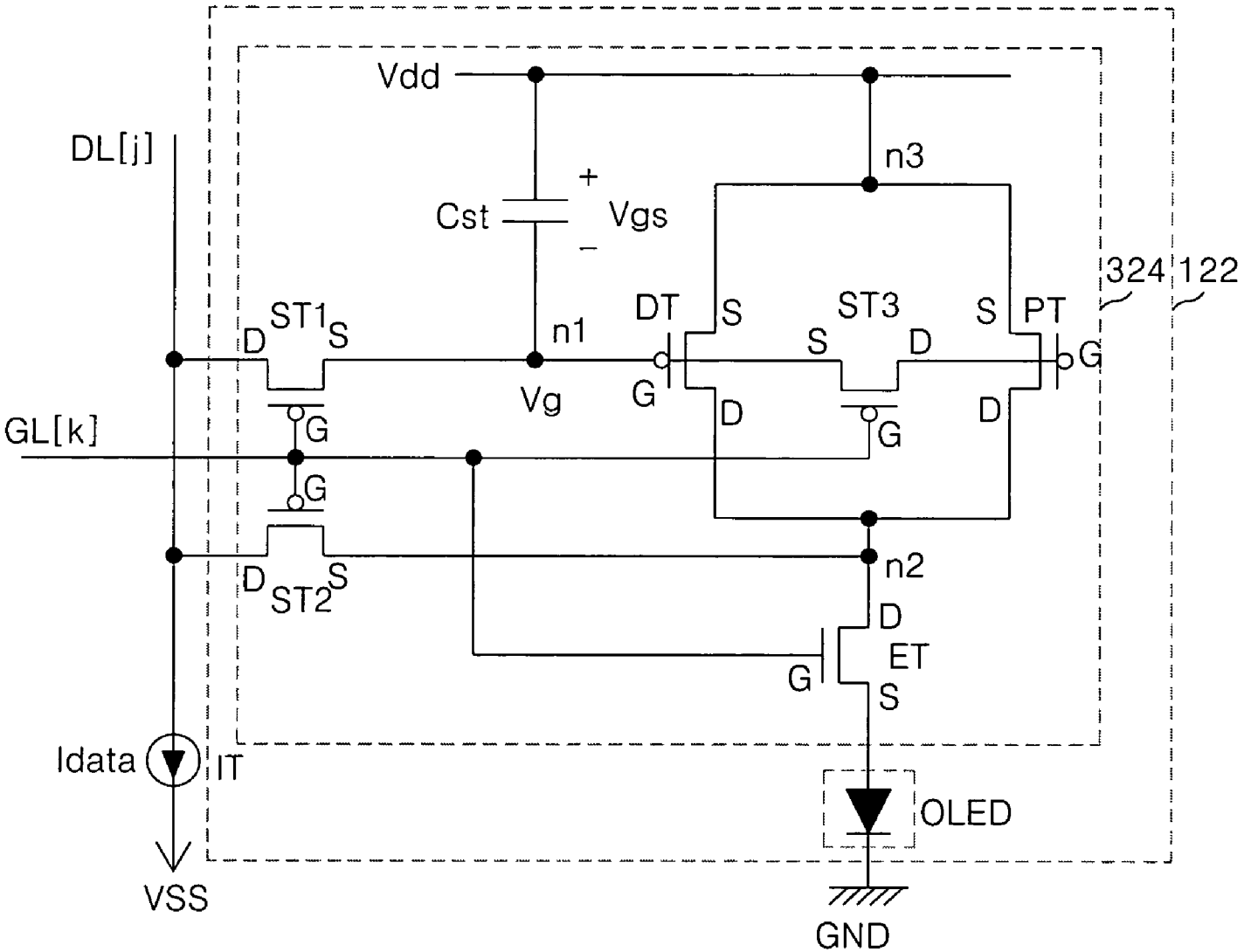
FIG. 11 is a circuit diagram showing a pixel according to the third embodiment of the present invention.
Figure 12A:
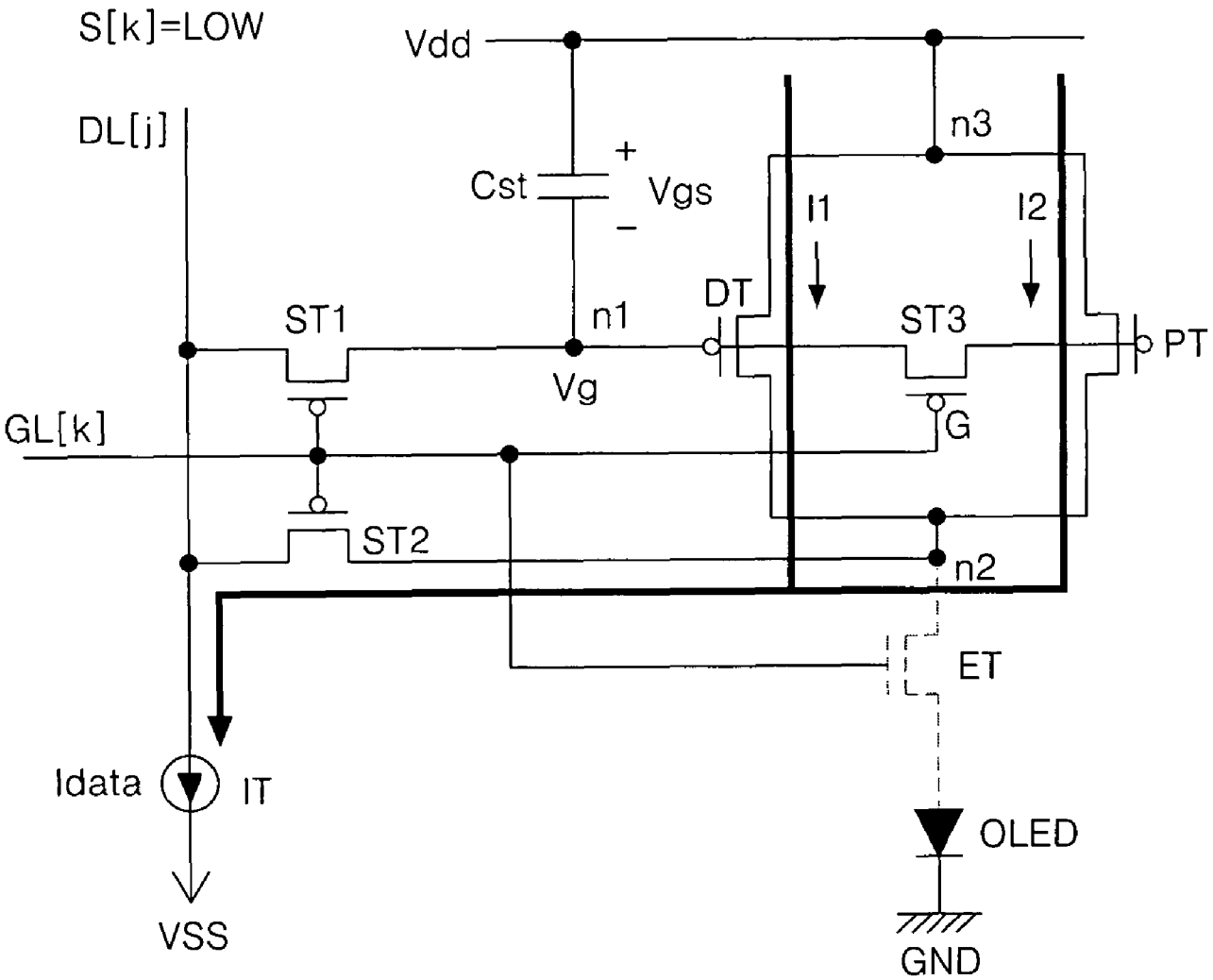
FIG. 12A is an equivalent circuit diagram of a pixel shown in FIG. 11 for the programming period PP.
Figure 12B:
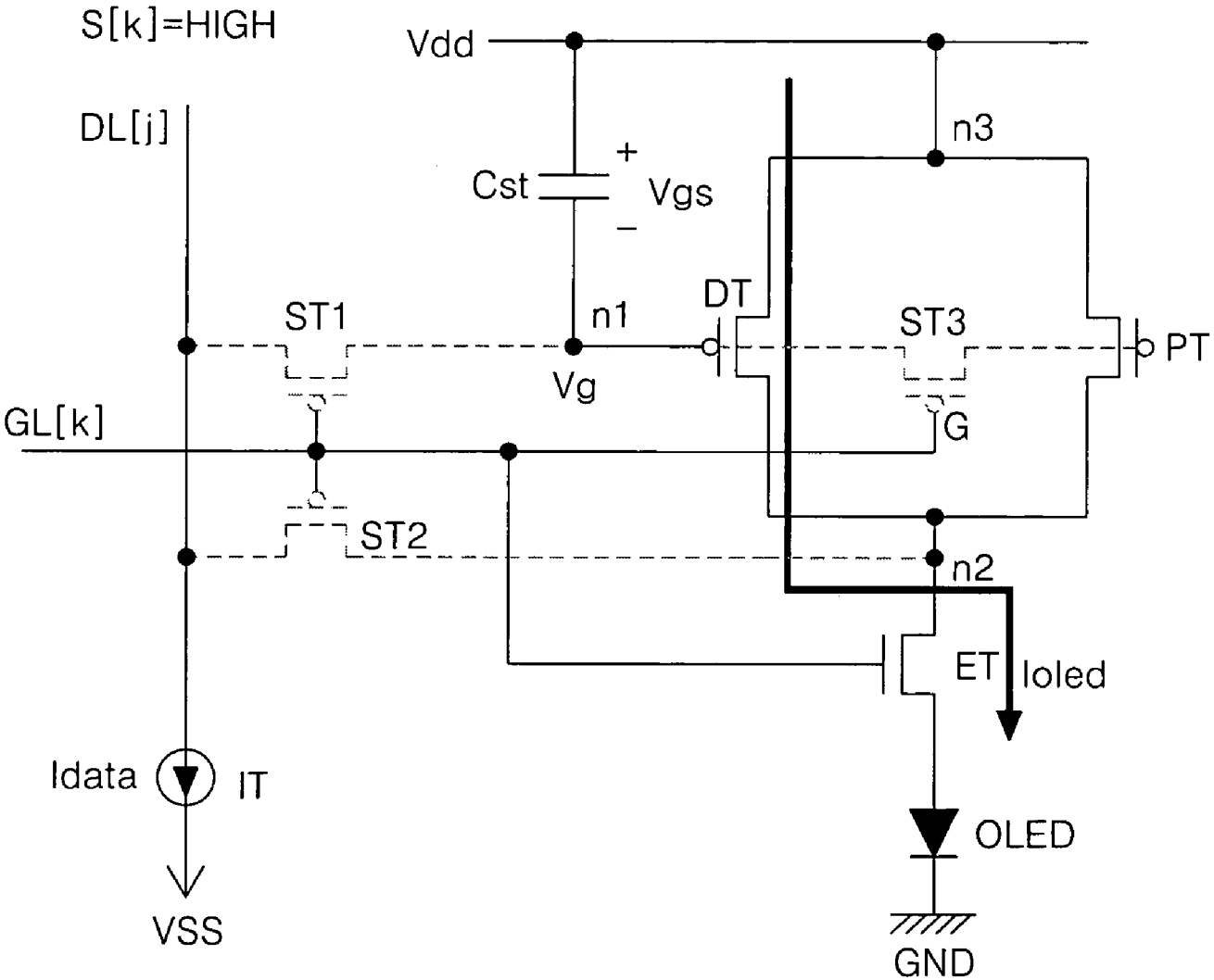
FIG. 12B is an equivalent circuit diagram of a pixel shown in FIG. 11 for the light emitting period EP.

FIG. 11 to FIG. 12B show a pixel 122 according to the third embodiment of the present invention.

FIG. 11 is a circuit diagram showing the pixel 122 which is located at a kth location (herein, k is a positive integer, $1 \leqq k \leqq n$) in a vertical direction of FIG. 6, and is located at a jth location (herein, j is a positive integer, $1 \leqq j \leqq m$) in a horizontal direction of FIG. 6. FIG. 12A is an equivalent circuit diagram of the pixel 122 shown in FIG. 11 during the programming period PP, and FIG. 12B is an equivalent circuit diagram of the pixel 122 shown in FIG. 11 during the light emitting period EP. The pixel 122 according to the third embodiment of the present invention has similar configurations in its function and operation except for an emission TFT ET compared to a pixel according to the first embodiment. Accordingly, the same reference numerals as the first embodiment are given to other configurations except for the emission TFT ET, and a specific description of operations thereof will be omitted.

Referring to FIG. 11, a gate electrode G of the emission TFT ET is connected to the gate line GL[k], a drain electrode D thereof is connected to the second node n2, and a source electrode S thereof is connected to an anode electrode of the organic light emitting diode device OLED. The emission TFT ET is an N-type Metal-Oxide Semiconductor Field Effect Transistor MOSFET, and does not require an additional emission line.

Referring to FIG. 12A and FIG. 12B, the emission TFT ET is turned-off by the scanning pulse S[k], which is generated as the low logical voltage during the programming period PP, to cut-off a current flowing into the organic light emitting diode device OLED. By an operation of the emission TFT ET, a contrast ratio of an image can be highly improved. The emission TFT ET is turned-on by the scanning pulse S[k], which is generated as the high logical voltage during the light emitting period EP, to allow the driving current Ioled to flow into the organic light emitting diode device OLED.

As a result, the pixel 122 according to the third embodiment of the present invention can further improve a contrast ratio by adding the emission TFT ET to a pixel according to the first embodiment of the present invention to.

Figure 13:
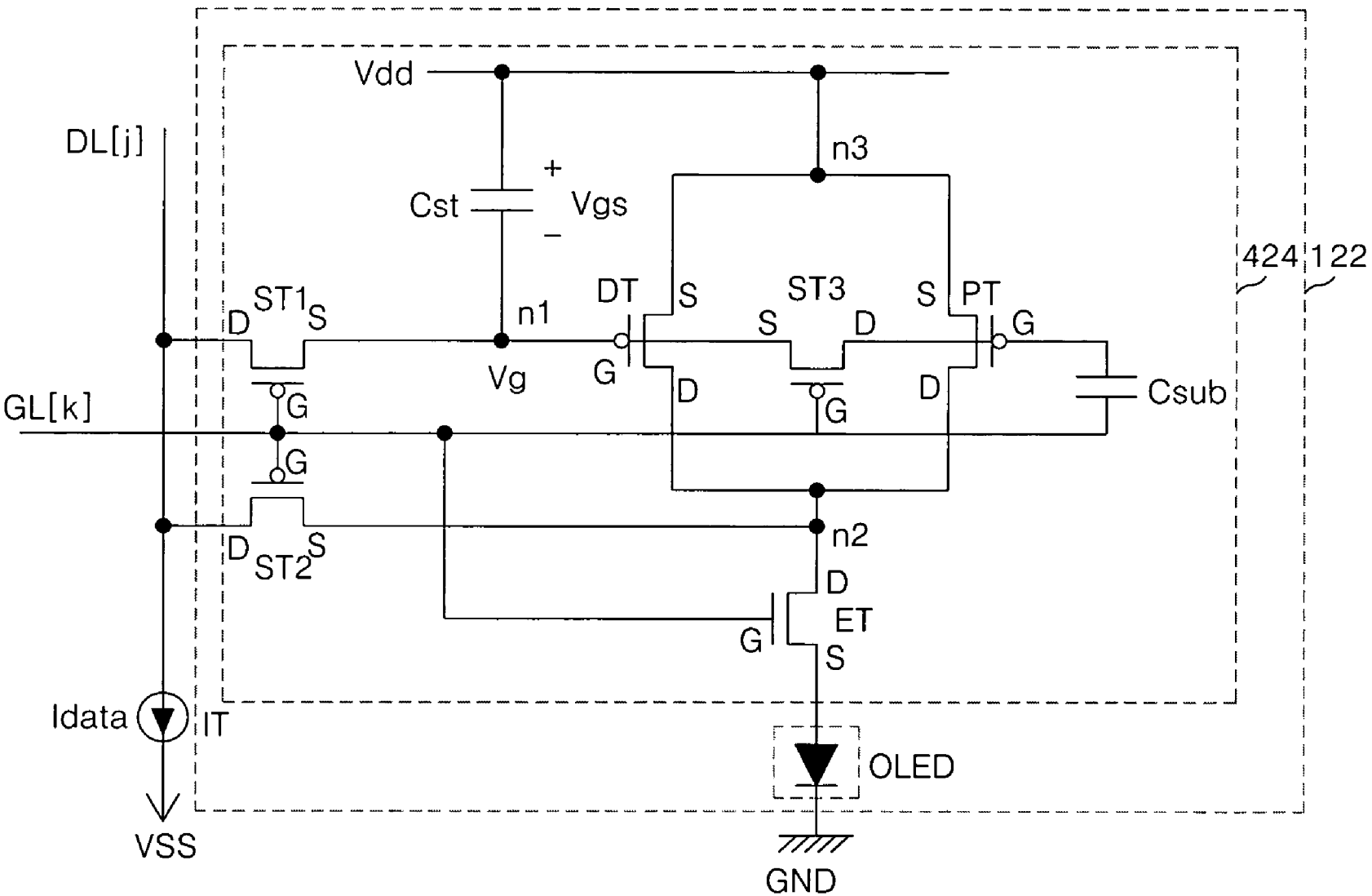
FIG. 13 is a circuit diagram showing a pixel according to the fourth embodiment of the present invention.

FIG. 13 is a circuit diagram showing a pixel 122 according to the fourth embodiment of the present invention.

FIG. 13 is a circuit diagram showing the pixel 122 which is located at a kth location (herein, k is a positive integer, $1 \leqq k \leqq n$) in a vertical direction of FIG. 6, and is located at a jth location (herein, j is a positive integer, $1 \leqq j \leqq m$) in a horizontal direction of FIG. 6. The pixel 122 according to the fourth embodiment of the present invention has similar configurations in its function and operation except for the sub capacitor Csub and the emission TFT ET compared to a pixel according to the first embodiment. Accordingly, the same reference numerals as the first embodiment are given to other configurations except for the sub capacitor Csub and the emission TFT ET, and a specific description of operations thereof will be omitted.

Referring to FIG. 13, the sub capacitor Csub is connected between the gate electrode G of the programming TFT PT and the gate line GL[k]. The sub capacitor Csub has a very small size compared to the storage capacitor Cst. The sub capacitor Csub can be formed by using a parasitic capacitance or a cross-over capacitance which reside on a layout of pixels, not introducing additional processes. Thus, although the sub capacitor Csub is added, practically, it does not decrease an aperture ratio of a pixel. Since a function and an operation of the sub capacitor Csub is the same as those of the sub capacitor Csub in the second embodiment, a specific description of them will be omitted.

The gate electrode G of the emission TFT ET is connected to the gate line GL[k], the drain electrode D thereof is connected to the second node n2, and the source electrode S thereof is connected to the anode electrode of the organic light emitting diode device OLED. The emission TFT ET is an N-type Metal-Oxide Semiconductor Field Effect Transistor MOSFET, and does not require an additional emission line. Since a function and an operation of the emission TFT ET is the same as those of the emission TFT ET in the third embodiment, a specific description of the function and the operation of the emission TFT ET will be omitted.

As a result, the pixel 122 according to the fourth embodiment of the present invention can further improve a contrast ratio, by adding the sub capacitor Csub and the emission TFT ET to a pixel according to the first embodiment of the present invention to.

As described above, the organic light emitting diode display and the driving method thereof according to the present invention fully reflect characteristics of the driving TFT when setting the control voltage during the programming period and sharply reduce a mismatching ratio between the driving TFT and the programming TFT. As a result, the organic light emitting diode display and the driving method thereof according to the present invention improve ability to express a gray scale during the light emitting period, thereby increasing a display quality.

Moreover, the organic light emitting diode display and the driving method thereof according to the present invention increase a scaling ratio compared to that of the related art in the same conditions, thereby sharply reducing a charging time of the control voltage.

Furthermore, the organic light emitting diode display and the driving method thereof according to the present invention improve a contrast ratio of an image by using the sub capacitor and/or the emission TFT, thereby further increasing a display quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. For example, in the embodiment of the present invention, the switch TFT, the programming TFT, and the driving TFT are formed as a P-type TFT, and the emission TFT is formed as a N-type TFT. On the contrary, the switch TFT, the programming TFT, and the driving TFT may be formed as a N-type TFT, while the emission TFT may be formed as a P-type TFT. Accordingly, the scope of the invention shall be determined only by the appended claims and their equivalents.

What is claimed is:

1. An organic light emitting diode display, comprising:

a first driving device that includes a first control electrode supplied with a voltage from a first node, and is connected between a second node and a third node;

a second driving device that is connected to be symmetrical with the first driving device through the second node and the third node, and includes a second control electrode supplied with a voltage of the first node;

a high-level driving voltage source that supplies a high-level driving voltage via the third node;

an organic light emitting diode device that is connected between the second node and a ground voltage source;

a gate line and a data line which are crossed each other;

a first switch device that selectively connects the data line with the first node;

a second switch device that selectively connects the second node with the data line;

a third switch device that selectively connects the first control electrode with the second control electrode;

a driving circuit that drives the first to third switch devices to turn-on the first to third switch devices, thereby forming a parallel current path between the second node and the third node via the first and second driving devices for a first period, and then to turn-off the first to third switch devices, thereby forming a series current path between the second node and the third node via the first driving device for a second period; and a storage capacitor that is connected between the first node and the third node.

2. The organic light emitting diode display according to claim 1, wherein, the first switch device has a gate electrode connected to the gate line, a source electrode connected to the first node, and a drain electrode connected to the data line;

the second switch device that has a gate electrode connected to the gate line, a source electrode connected to the second node, and a drain electrode connected to the data line; and the third switch device that has a gate electrode connected to the gate line, a source electrode connected to the first control electrode, and a drain electrode connected to the second control electrode.

3. The organic light emitting diode display according to claim 2, wherein the driving circuit includes:

a gate driving circuit that supplies a scanning signal to the gate line;

a data driving circuit that converts a digital data signal into an analog data current to supply it to the data line; and a timing controller that controls driving timings of the gate driving circuit and the data driving circuit.

4. The organic light emitting diode display according to claim 3, wherein the scanning signal is generated as a high logical voltage for the first period, and is generated as a low logical voltage for the second period.

5. The organic light emitting diode display according to claim 4, wherein the data driving circuit includes:

a constant current source that generates the analog data current.

6. The organic light emitting diode display according to claim 5, wherein a channel width of the second driving device is larger than that of the first driving device.

7. The organic light emitting diode display according to claim 6, wherein a driving current, which flows via the organic light emitting diode device for the second period, is determined according to the following Mathematical Formula, and wherein $$Ioled = \frac{Kd}{2Kd + Ks}\left[1 + \left(\frac{\mu d - \mu s}{\mu s + \mu s}\right) + \left(\frac{Vthd - Vths}{Vthd + Vths}\right)^2\right] Idata$$

Idata represents a data current which is generated via the constant current source, Kd represents a natural constant of the first driving device, Ks represents a natural constant of the second driving device, μd represents mobility of the first driving device, μs represents mobility of the second driving device, Vthd represents a threshold voltage of the first driving device, and Vths represents a threshold voltage of the second driving device, (2 Kd+Ks)/Kd represents a scaling ratio (Idata/Ioled) that increases an ability of charging a current of the first node during the first period, and $$\left(\frac{\mu d - \mu s}{\mu d + \mu s}\right) + \left(\frac{Vthd - Vths}{Vthd + Vths}\right)^2$$

represents a mismatching factor caused by a characteristics discrepancy between the first and second driving devices.

8. The organic light emitting diode display according to claim 7, further includes:

a sub capacitor that cuts-off a current path via the second driving device during the second period.

9. The organic light emitting diode display according to claim 8, wherein the sub capacitor is connected between the second control electrode and the gate line.

10. The organic light emitting diode display according to claim 7, further includes:

an emission device that switches a current path formed between the second node and the organic light emitting diode device.

11. The organic light emitting diode display according to claim 10, wherein the emission device includes:

a gate electrode connected to the gate line, a drain electrode connected to the second node, and a source electrode connected to the organic light emitting diode device.

12. The organic light emitting diode display according to claim 11, wherein the first and second driving devices and the first to third switch devices are P-type MOSFETs, and the emission device is a N-type MOSFET.

13. The organic light emitting diode display according to claim 7, further includes:

a sub capacitor that cuts-off a current path via the second driving device during the second period; and an emission device that switches a current path formed between the second node and the organic light emitting diode device.

14. The organic light emitting diode display according to claim 13, wherein the sub capacitor is connected between the second control electrode and the gate line.

15. The organic light emitting diode display according to claim 13, wherein the emission device includes:

a gate electrode connected to the gate line, a drain electrode connected to the second node, and a source electrode connected to the organic light emitting diode device.

16. The organic light emitting diode display according to claim 15, wherein the first and second driving devices and the first to third switch devices are P-type MOSFETs, and the emission device is a N-type MOSFET.

17. A method of driving an organic light emitting diode display, including a first driving device that includes a first control electrode supplied with a voltage of a first node, and is connected between a second node and a third node, a second device that is connected to be symmetrical with the first driving device via the second node and the third node, and includes a second control electrode supplied with a voltage of the first node, a high-level driving voltage source that supplies a high-level driving voltage via the third node, an organic light emitting diode device that is connected between the second node and a ground voltage source, a gate line and a data line which are crossed each other, a first switch device that selectively connects the data line with the first node, a second switch device that selectively connects the second node with the data line, a third switch device selectively connects the first control electrode with the second control electrode, a driving circuit that drives the switch devices, and a storage capacitor that is connected between the first node and the third node, the method comprising:

turning-on the first to third switch devices to form a parallel current path between the second node and the third node via the first and second driving devices during a first period; and turning-off the first to third switch devices to form a series current path between the second node and the third node via the first driving device during a second period following the first period in response to a scanning signal from the gate line.

18. The method of driving the organic light emitting diode display according to claim 17, wherein the scanning signal are generated as a high logical voltage during the first period, and are generated as a low logical voltage during the second period.

19. The method of driving the organic light emitting diode display according to claim 18, wherein the driving circuit includes:

a constant current source that generates an analog data current corresponding to a digital data signal.

20. The method of driving the organic light emitting diode display according to claim 19, wherein a channel width of the second driving device is larger than that of the first driving device.

21. The method of the organic light emitting diode display according to claim 20, wherein a driving current, which flows via the organic light emitting diode device during the second period, is determined according to the following Mathematical Formula, and wherein $$Ioled = \frac{Kd}{2Kd + Ks}\left[1 + \left(\frac{\mu d - \mu s}{\mu s + \mu s}\right) + \left(\frac{Vthd - Vths}{Vthd + Vths}\right)^2\right] Idata$$

Idata represents a data current which is generated via the constant current source, Kd represents a natural constant of the first driving device, Ks represents a natural constant of the second driving device, μd represents mobility of the first driving device, μs represents mobility of the second driving device, Vthd represents a threshold voltage of a first driving device, and Vths represents a threshold voltage of the second driving device, (2 Kd+Ks)/Kd represents a scaling ratio (Idata/Ioled) that increases an ability of charging a current of the first node during the first period, and $$\left(\frac{\mu d - \mu s}{\mu d + \mu s}\right) + \left(\frac{Vthd - Vths}{Vthd + Vths}\right)^2$$

represents a mismatching factor caused by a characteristics discrepancy between the first and second driving devices.

22. The method of the organic light emitting diode display according to claim 21, further includes:

cutting-off a current path via the second driving device by using a sub capacitor connected between the second control electrode and the gate line during the second period.

23. The method of the organic light emitting diode display according to claim 21, further includes:

switching a current path formed between the second node and the organic light emitting diode device by using an emission device responding to the scanning pulse.

24. The method of the organic light emitting diode display according to claim 21, further includes:

cutting-off a current path via the second driving device by using a sub capacitor connected between the second control electrode and the gate line during the second period; and switching a current path formed between the second node and the organic light emitting diode device by using an emission device responding to the scanning pulses.

* * * * *